United States Patent [19]

Rain

[11] 4,029,117

[45] June 14, 1977

[54] SHELTER STRUCTURE

[75] Inventor: Lloyd Howard Rain, Lexington, Ky.

[73] Assignee: Irvin Industries, Inc., Greenwich, Conn.

[22] Filed: Jan. 26, 1976

[21] Appl. No.: 652,553

[52] U.S. Cl. ..... 135/4 C; 135/15 CF; 135/15 PQ

[51] Int. Cl.[2] ..... A45F 1/16

[58] Field of Search ..... 135/1 C, 3 B, 4 C, 15 CF, 135/15 PQ; 248/76, 80, 346; 182/108

[56] References Cited

UNITED STATES PATENTS

| | | | |
|---|---|---|---|
| 842,672 | 1/1907 | Kirby | 135/4 C |
| 2,273,124 | 2/1942 | McDaniels | 182/108 |
| 2,466,496 | 4/1949 | Smith | 135/4 C |
| 2,599,169 | 6/1952 | Finney | 182/214 |
| 2,663,306 | 12/1953 | Davis | 135/4 C |
| 2,783,766 | 3/1957 | Kohlbeck | 135/1 C |
| 2,864,389 | 12/1958 | Smith et al. | 135/2 |
| 3,059,655 | 10/1962 | Bird | 135/15 CF X |
| 3,150,670 | 9/1964 | Bird et al. | 135/15 CF X |
| 3,738,378 | 6/1973 | Williams | 135/2 |
| 3,807,421 | 4/1974 | Geiger et al. | 135/15 CF X |
| 3,929,146 | 12/1975 | Maiken | 135/2 |

FOREIGN PATENTS OR APPLICATIONS

| | | | |
|---|---|---|---|
| 1,159,434 | 2/1958 | France | 135/1 C |
| 1,307,057 | 9/1962 | France | 135/4 C |

*Primary Examiner*—Werner H. Schroeder
*Assistant Examiner*—Conrad L. Berman
*Attorney, Agent, or Firm*—McAulay, Fields, Fisher & Goldstein

[57] ABSTRACT

A collapsible, readily erectable shelter structure in the form of a pyramid having a plurality of fabric panels draped over and connected to a plurality of rigid columns. Each column is hinged at its top to a top plate and extends downwardly and outwardly to form the frame of the pyramidical structure. Each column is attached to a foot plate which rests on the ground. A central cable hangs down from the top plate and is adapted to be cinched to an item, such as a vehicle, that is being protected by the shelter. The central member is thereby placed under tension and the side columns are placed under compression. A plurality of tapes or webs or cables sewn to the panels are connected between adjacent side columns. When the structure is loaded, as by wind or snow, the foot plates tend to move outward and the tapes are placed under tension. The tapes resist the outward movement of the columns. The tapes are sewn along a catenary line and distribute the resisting force evenly across the fabric panel to which they are sewn.

8 Claims, 11 Drawing Figures

Fig. 1.
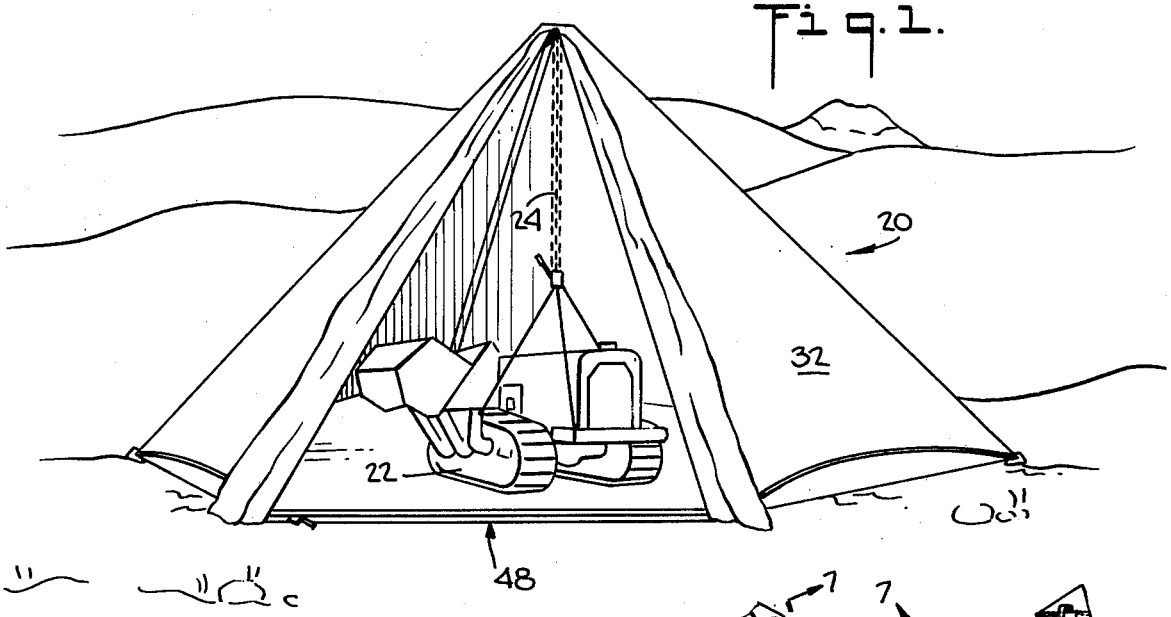
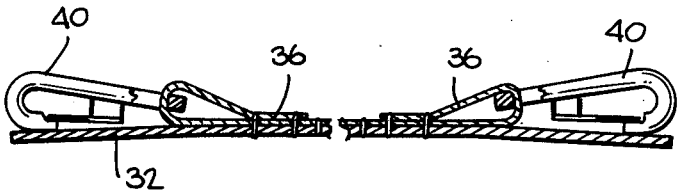
Fig. 7.
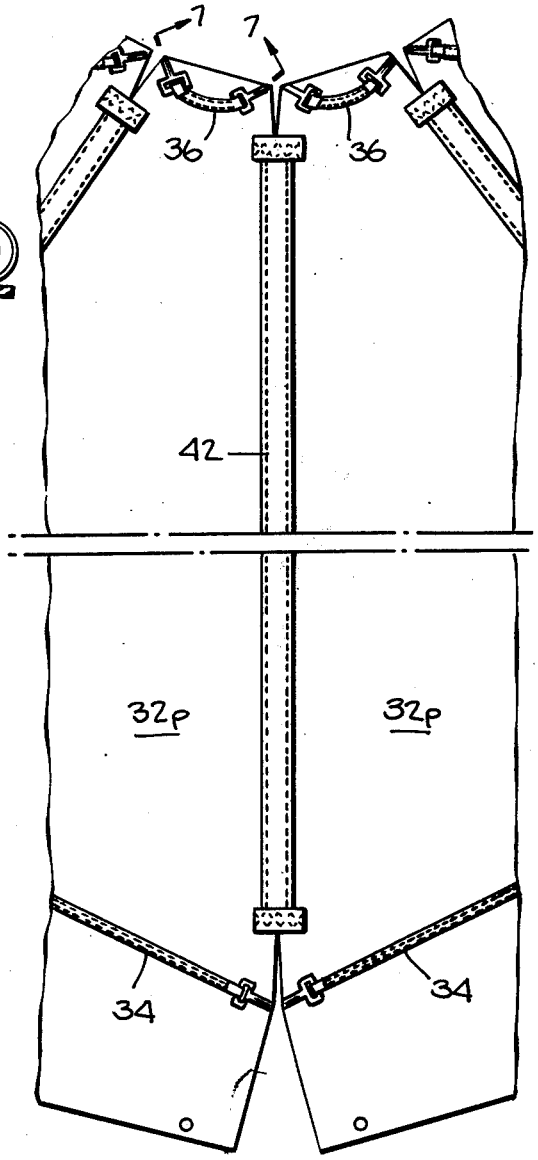
Fig. 6.

26
34
40
34
30

26
34
40
42
32
41
38
30

28
46
32
26
34
34c
34
48
47
10
10
11
11

SHELTER STRUCTURE

BACKGROUND OF THE INVENTION

There are a large number of tents and other quickly erectable instant shelters used for a wide variety of purposes. Apart from personal tents and the like, most instant shelters require some sort of anchoring into the ground in order to resist wind loading. However, there are terrain conditions where an instant shelter cannot be anchored to the ground. Where the shelter is to be erected on rock, loose fill, gravel, snow, ice and even certain types of irregular terrain, the ground cannot be used as the medium into which the shelter is anchored.

Accordingly, it is a major purpose of this invention to provide an instant shelter which can be raised on a wide variety of terrain and which does not require an anchor that is sunken into the ground to provide anchorage against wind.

Heavy, rigid structures can be used on terrain where the structure cannot be anchored to the terrain. However, heavy rigid structures cannot be brought to all the various places where an instant shelter is required.

Accordingly, it is a further purpose of this invention that the instant shelter be light weight for its size and further that it be collapsible or foldable into a relatively compact arrangement so that it can be readily shipped to locations where required.

Many conditions under which an instant shelter is required call for erection of the shelter in a short time period, by few personnel and in inclement weather.

Accordingly, it is a further purpose of this invention that the instant shelter provided be simple to erect so that it can be put up quickly and so that its erection requires no more than two inexperienced men.

To assure rapid erection of the shelter in a wide variety of places, it is a further purpose of this invention that the instant shelter require only simple equipment for erection of the shelter and instructions which can be simply set forth and can be followed by relatively inexperienced personnel.

From a practical point of view, it is of course important that all of the above purposes be achieved in a structure which is not only a simple structure but is also rugged and can be fabricated from relatively inexpensive materials.

BRIEF DESCRIPTION OF THE INVENTION

In brief, an embodiment of this invention employs six rigid columns arranged in a pyramidical fashion. The top ends of these rigid columns are connected to a top plate. The six rigid columns are mounted to the top plate so that the columns can be pivoted outwardly and inwardly to a limited extent to adjust to loading and to uneven ground.

There is a foot plate at the base of each column to support the column on the ground. A pyramidical canopy is draped over the columns and connected to the columns so that there is a triangular or trapezoidal fabric panel between adjacent columns.

A flexible base tension member is connected between the bases of adjacent columns. The tension member is stitched to the corresponding fabric panel along the entire length of the flexible tension member and is so connected along a curved line across the fabric panel. When a force, such as wind loading is applied that tends to cause the columns to spread outwardly, these flexible base tension members will hold the columns in and the force on the fabric panels will be substantially uniformly distributed across the panels.

A similar set of flexible top tension members is preferably included connecting the tops of adjacent columns and being connected in a curved line along their entire lengths to the corresponding canopy panel.

A flexible tension member such as a chain hangs down from the top plate in the center of the shelter. This chain is adapted to be connected to a weight such as the vehicle which the shelter may be protecting. The weight of the vehicle resists any tendency of the shelter to fly up under wind loading. The downward force exerted on the top plate by the central tension member is resisted by compressive forces in the rigid side columns. These compressive forces cause the foot plates to press against the terrain. The net result is a canopy type shelter or tentlike shelter in which the central member is in tension and the sloping side columns are in compression.

BRIEF DESCRIPTION OF THE DRAWINGS

All of the Figures are of the same embodiment.

FIG. 1 is a perspective view of an embodiment of this invention showing its use to provide shelter for a tractor.

FIG. 3 is a perspective view showing the FIG. 1 structure disassembled and rolled up for shipment.

FIG. 6 is a view of a portion of the canopy structure showing the transverse, arced, tension members which are sewn to the fabric panels.

FIG. 7 is a view along the section 7—7 of FIG. 6 illustrating in greater detail the connection of a transverse tension member to the canopy fabric.

DESCRIPTION OF THE PREFERRED EMBODIMENTS

All of the FIGS. relate to the same embodiment. As illustrated in FIG. 1, the structure 20 of this invention can be used to protect, for example, a tractor 22 from inclement weather such as snow and rain. The tractor 22 is tied to the structure 20 through a central chain 24. Any winds which would tend to shift or lift the structure 20 will be resisted by the weight of the tractor 22 applying a tensile force through the chain 24 to the rest of the structure 20.

Figure 2:
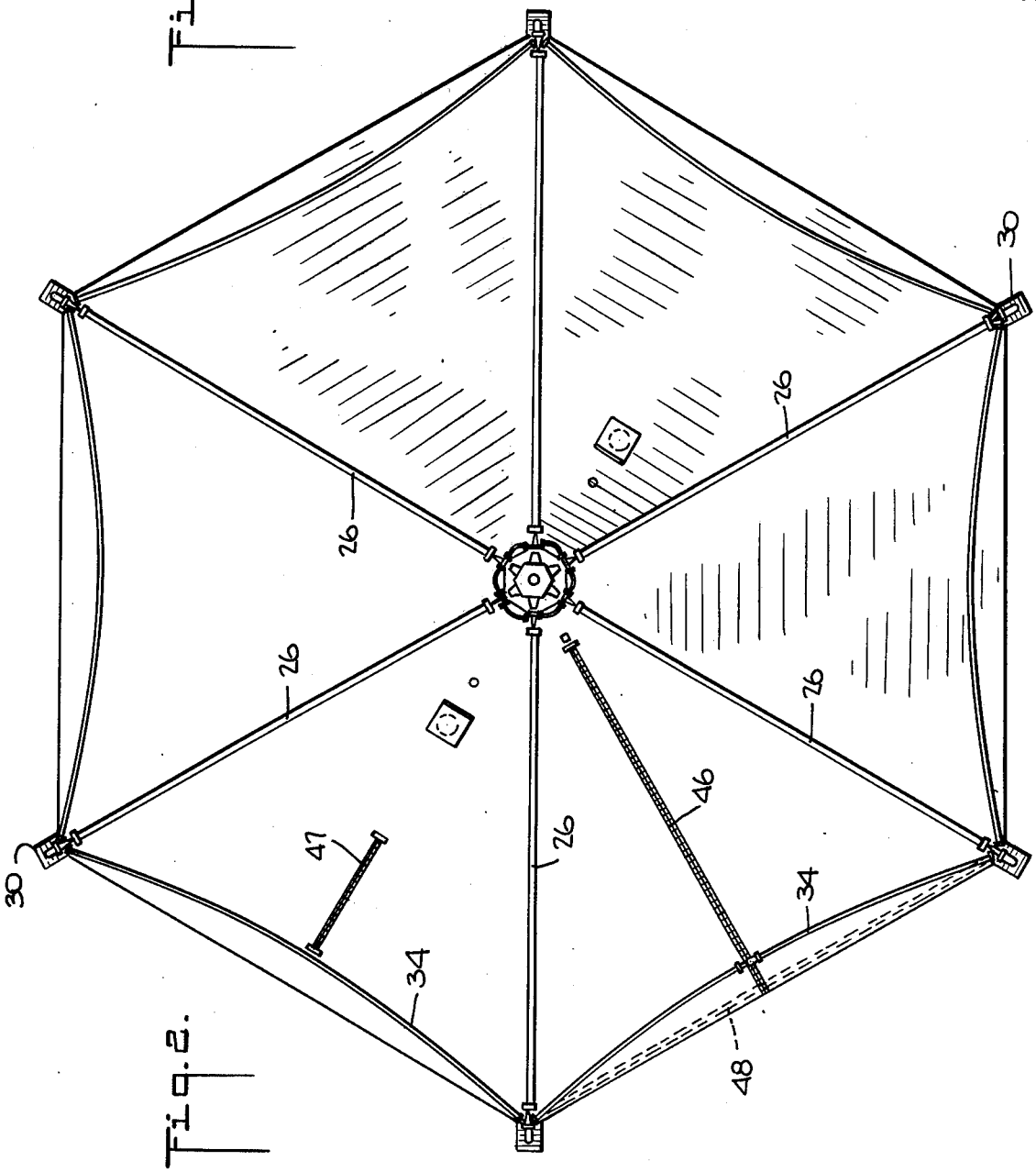
FIG. 2 is a plan view of the FIG. 1 structure.
Figures 4, 5:
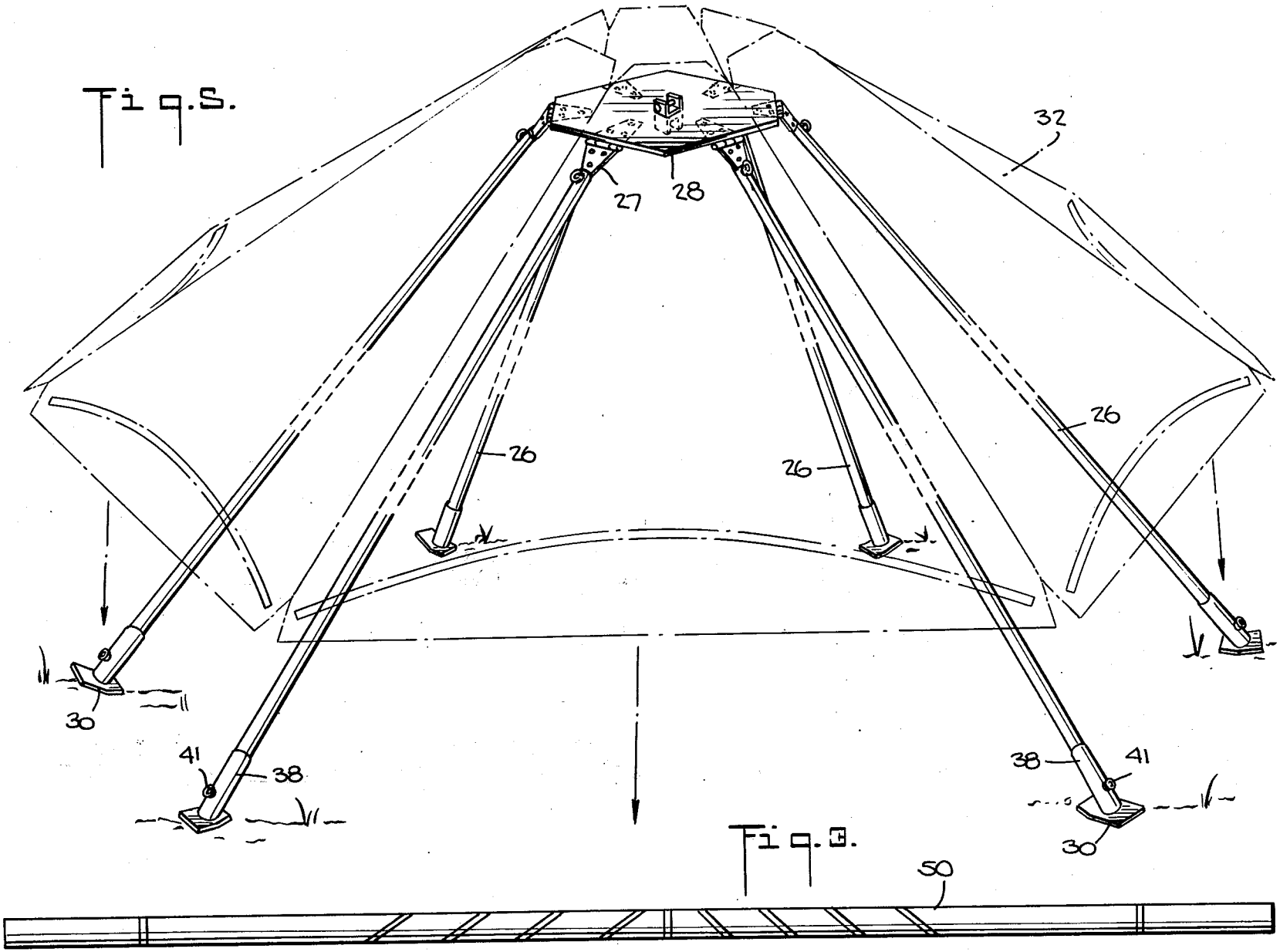
FIG. 4 is an elevation view of the FIG. 1 structure.
FIG. 5 is a perspective view of the FIG. 1 structure illustrating the placing of the pyramidical multi-panel fabric canopy on the frame.

As can better be seen in FIGS. 2 and 4, the structure 20 includes six rigid columns 26 arranged in a pyramidical fashion. Each column 26 is hinged to a top plate 28 (best seen in FIG. 5) so that the columns 26 can pivot out to a limited extent about a horizontal axis. Each column 26 rests on a foot plate 30, which foot plate 30 in turn rests on the ground.

Figure 10:
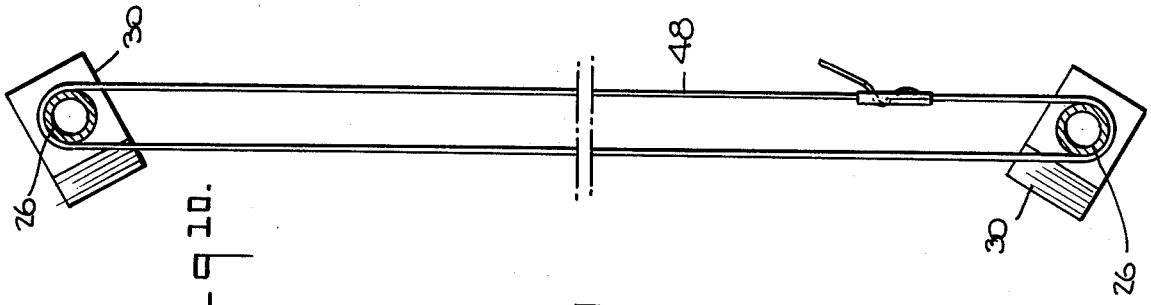
FIG. 10 is a view looking down along section 10—10 of FIG. 4.
Figures 4, 8, 9:
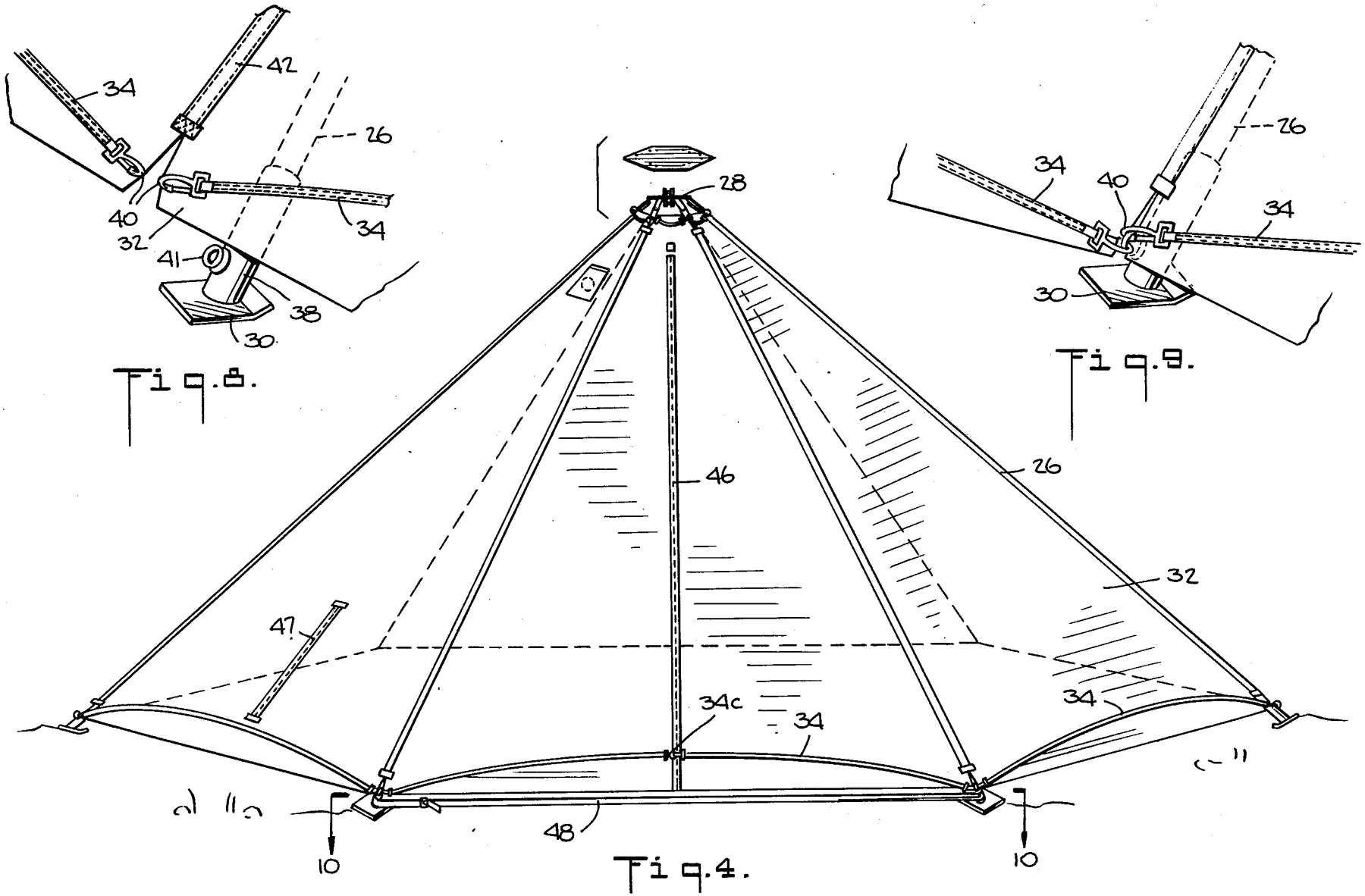
FIG. 8 is a perspective view of a lower corner showing the canopy in position to be connected to one of the side pyramidical columns.
FIG. 9 is a view similar to that of FIG. 8 showing the connection made between canopy and side pyramidical column at the base of the structure.

Around this frame of columns 26 there is draped a multipanel pyramidical fabric canopy 32. This canopy 32 is connected to each column 26 at the top and at the base of each column 26. FIGS. 8, 9 and 10 best illustrate the connection of the canopy to the base of a column 26.

A flexible tape 34 having appreciable strength in tension is sewn across the base of each panel 32*p* of the canopy 32. This tape member 34 extends in an upward arc from one base corner of each panel 32*p* to the other base corner of that panel. In the embodiment shown there are six panels and thus there are six of these tape tension members 34. When a panel 32*p* is stretched taut, the curvature of the tape 34 is designed to be catenary in shape. Accordingly, when the structure is subjected to forces which tend to push the foot plate 30 in an outward direction, the tapes 34 will be placed under tension and will resist such forces. However, because of the curved and preferably catenary arc of the tape 34, these forces will be transmitted to the panels 32*p* in an even fashion so that the panels 32*p* will not pucker and, perhaps more importantly, localized stresses in the panels 32*p* will be minimized.

A corresponding set of apex catenary tapes 36 (see FIG. 6) are sewn to the panels near the apex of each panel close to the apex plate 28. These apex tapes 36 are placed under tension when the structure is wind loaded and perform a function similar to that of the base tapes 34.

The base of each rigid column 26 is received in a tubular member 38 which is welded to the foot plate 30.

Figure 11:
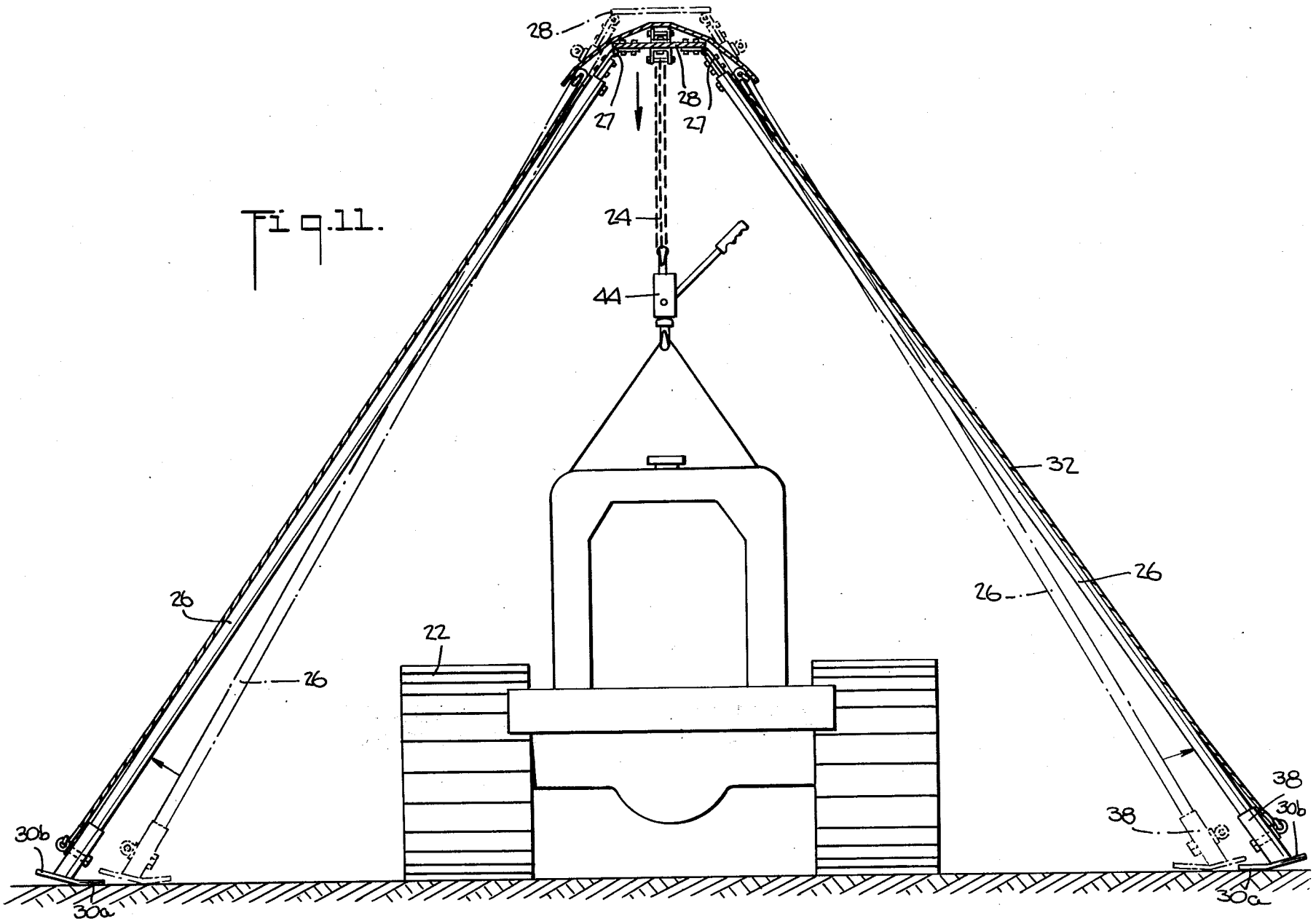
FIG. 11 is a cross-sectional view along a vertical plane showing the attachment to the tractor being sheltered by the structure and the relationship of the interior of the structure to the tractor.

The foot plates 30 provide a number of functions. First, they make sure that each column 26 has an adequate resting place on the ground. The arrangement wherein the columns 26 are hinged to the top plate 28 to provide some radial play in the positioning of the columns in combination with the foot plates 30 maximizes the user's ability to set the structure down in a solid fashion on a wide variety of uneven grounds. Second, the foot plate 30 permits the base of the columns 26 to slide outwardly under loading stresses so that full structural advantage of the tension tapes 34 can be had. In order to assure that the foot plates 30 will slide outward and not dig into the ground, the foot plate design shown is preferred in which the foot plate has two portions 30*a* and 30*b*. As may best be seen in FIG. 11, the portion 30*a* rests on the ground and the portion 30*b* extends up from the ground at a small angle in an outward direction. Thus forces from the columns 26 tending to move the foot plates 30 outward will result in the foot plate 30 moving outward because there is no edge to bite into the earth.

Third, the foot plate 30 provide a further advantage arising from the fact that the column 26 is connected to the outboard portion 30*b*. In this fashion, the force from the ground resisting the weight of the structure is directed upward at the horizontal foot plate portion 30*a* which is inboard of the lower end of each column 26. The result is a moment at the lower end of the column 26 which tends to rotate the column 26 in an outward direction about the foot plate 30 thereby aiding in resisting wind or snow loading of the panels 32*p*.

As may best be seen in FIGS. 7, 8, and 9, the tension tapes 34 and 36 are connected at each end to hooks 40 which in turn can be hooked onto a ring 41 that is permanently fastened to the column 26 support structure.

The canopy 32 is comprised of a number of panels 32*p* which are sewn together along their edges through a longitudinal tape 42.

The chain 24 includes a cinch buckle 44 so that the chain 24 can be tightened down and subjected to an appreciable amount of tension due to the weight of the tractor 22.

When erected and connected to an anchoring device such as the tractor 22, the structure 20 operates by maintaining tension in the cable 24 and compression in the side columns 26. The central tension member 24 and side compression members 26 operate in combination to force the foot plates 30 down against the ground thereby resisting the tendency due to wind loading for the structure to lift or tilt. Furthermore, this combination of the central tension member and side compression members free to pivot outwardly in response to the compression forces on the side columns 26 results in a taut canopy panel 32*p* structure in which the transverse tension members 34 and 36 serve to resist further outward movement of the columns 26. Because these transverse tension members 34 and 36 are curved, preferably catenary, and are sewn to the panels 32*p* along the entire length of each tape 34 and 36, the force resisting the spreading apart of the columns 26 in compression is distributed fairly evenly across the surface of each panel 32*p*.

When subjected to wind loading, the top tends to shift. Any shifting puts the cable 24 under greater tension thereby increasing the compressive forces in the side columns 26. The result is that the structure 20 is pushed against the ground with increased force thereby resisting movement and providing a stability to counteract the wind loading.

The device shown in the Figures is shown with one vehicle entrance way 46 and one hatch 47 for personnel use. Both of these openings 46, 47 are sealed with a known type of heavy duty, rubber encased, nylon/-steel zipper. The personnel hatch 47 does not break the base tension tape 34 and thus when the hatch 47 is used, the individuals entering and leaving have to step over the tape 34. However, the corresponding tape 34 at the vehicle entrance way 46 has to be broken to permit rolling the vehicle in and out of the structure 20. Accordingly, at the vehicle entrance 46, the tape 34 is broken and a coupling 34*c* used to permit coupling and uncoupling the tape 34 as part of the closing of the entrance way 46. When coupled, the tape 34 at the entrance 46 operates as a single tension member in the same fashion as the rest of the tension tapes 34.

When the tape 34 at the vehicle entrance 46 is uncoupled, the structure 20 may well be subjected to wind and snow loading. Accordingly, a belt 48 (see FIG. 10) is coupled around the adjacent columns 26 to provide the transverse tension force that the tape 34 would normally provide. This belt arrangement 48 is required only at the panel 32*p* at which a vehicle opening 46 is provided.

The arrangement shown including the hinges 27, flexible canopy 32, and flexible tension tapes 34 permits the user to collapse the structure and fold and roll it into the compact arrangement 50 shown in FIG. 3 so that it can be readily transported from place to place and can accompany the vehicle it is designed to protect.

In one embodiment of the invention that has been built and tested, the length of the columns 26 was 22.28 feet, the angle of the columns 26 to the ground was 45°, the length of the base of each panel 32*p* was approximately 16 feet and the height of the apex off the ground was approximately 16 feet.

A preferred embodiment of the invention has been described in some detail. It should be understood that there are certain variations in the embodiment described which can be made without departing from the scope of this invention.

For example, the center tension member 24 is described as a flexible member such as a chain. Although it would not be as convenient to use, the center member could be rigid as long as it were designed so that it could be cinched down in a fashion that would put it under tension.

Another variation in design which would be possible would be to have the central tension member 24 anchored into the ground. The design of this invention is such as to permit use of the invention as a shelter where ground anchorage is not possible. Nonetheless, other advantages of the invention can be obtained by use of this structure in situations where a ground anchor is available. And the structure remains highly functional in that it only requires one anchorage location for total stability. In such cases, the central tension member would be anchored into the ground and it would be so anchored as to be placed under tension. The compression members 26, however, would not be so anchored.

What is claimed is:

1. A shelter comprising:

a plurality of at least three rigid columns arranged relative to one another to form the edges of a pyramidical structure, a top plate, said columns extending out and down from said top plate, each of said columns being pivoted in solely one plane about said top plate to permit radial movement of the base of said columns, a central tension member connected to and extending down from said top plate, said tension member being connected to an anchoring means, a pyramidical canopy connected to said columns and having a plurality of flexible panels, one of said panels extending across each of the surfaces of said pyramid defined by said columns, a plurality of flexible base tension members, each of said base tension members having first and second ends connected respectively to the bases of adjacent columns, each of said base tension members being connected along its entire length on a curved line across an associated one of said panels of said canopy between adjacent ones of said columns, and base means at the foot of each of said columns to permit radial movement of said columns in response to compressive loading of said columns, said base tension members and said canopy being the sole restraints on radial outward movement of said columns, loads on said canopy tending to spread said columns and cause said base tension members to decrease in curvature and to exert an increased substantially uniform tension across said panels of said canopy, thereby preventing canopy flutter and extending canopy life.

2. The shelter of claim 1 further comprising:

a plurality of flexible top tension members, each of said top tension members having first and second ends connected respectively to adjacent columns at a position close to but spaced from the top end of each of said columns, each of said top tension members being connected along its entire length on a curved line across an associated one of said panels of said canopy between adjacent ones of said columns.

3. The shelter of claim 2 wherein:

said central tension member is flexible.

4. The shelter of claim 1 wherein:

said central tension member is flexible.

5. The shelter of claim 1 wherein said base means comprises: a foot plate, said foot plate being a single piece bent to have a horizontal portion adapted to rest on the ground, and an angled portion extending up and out from said horizontal portion, the base of each of said columns being connected to said angled portion of the associated one of said foot plates.

6. The shelter of claim 5 wherein:

said central tension member is flexible.

7. The shelter of claim 5 further comprising:

a plurality of flexible top tension members, each of said top tension members having first and second ends connected respectively to adjacent columns at a position close to but spaced from the top end of each of said columns, each of said top tension members being connected along its entire length on a curved line across an associated one of said panels of said canopy between adjacent ones of said columns.

8. The shelter of claim 7 wherein:

said central tension member is flexible.

* * * * *